United States Patent [19]

Work et al.

[11] 4,379,252

[45] Apr. 5, 1983

[54] ARC DISCHARGE DEVICE CONTAINING HG196

[75] Inventors: Dale E. Work, Topsfield; Stephen G. Johnson, Georgetown, both of Mass.

[73] Assignee: GTE Products Corporation, Stamford, Conn.

[21] Appl. No.: 939,558

[22] Filed: Sep. 5, 1978

[51] Int. Cl.[3] ..... H01J 61/42; H01J 61/20

[52] U.S. Cl. ..... 313/485; 313/639

[58] Field of Search ..... 313/227, 485, 484

[56] References Cited

U.S. PATENT DOCUMENTS 3,993,379 11/1976 Waller ..... 313/227 X

FOREIGN PATENT DOCUMENTS 50-8594 4/1975 Japan ..... 313/485

OTHER PUBLICATIONS

"Isotope Effect in the Imprisonment of Resonance Radiation" by T. Holstein et al., *Physical Review*, vol. 85, No. 6, Mar. 1952, pp. 985–992.

Table of Isotopes, pp. 493, 494, *Handbook of Physics and Chemistry*, copyright 1961.

*Primary Examiner*—Palmer C. Demeo

*Attorney, Agent, or Firm*—James Theodosopoulos

[57] ABSTRACT

In a mercury-containing arc discharge device for converting electrical energy into resonance radiation, the isotopic distribution of the mercury in the device is altered from that of natural mercury so as to reduce imprisonment time of resonance radiation and thereby increase the efficiency of conversion of electrical energy into resonance radiation.

7 Claims, 1 Drawing Figure

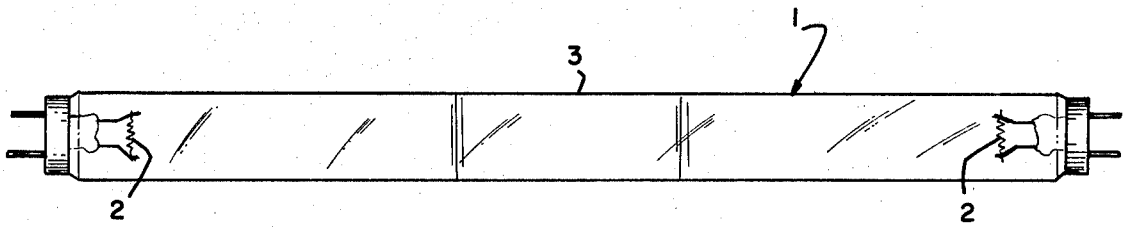
1
3
2
2

ARC DISCHARGE DEVICE CONTAINING HG196

THE INVENTION

This invention concerns a mercury-containing arc discharge device for converting electrical energy into resonance radiation. It is particularly concerned with improving the efficiency of such conversion. An example of such a device is a fluorescent lamp. Such a lamp comprises a tubular glass envelope having electrodes at its end, containing a fill of mercury and an inert gas, and having a phosphor coating on the inner envelope wall. In fluorescent lamps, electrical energy is converted into the kinetic energy of free electrons which in turn is converted into the internal energy of atoms and molecules, which in turn is converted into radiant energy, and chiefly into the resonance radiation at the 254 nanometer (nm) region of the electromagnetic spectrum, which in turn is converted into luminous energy by the phosphor. A great deal of effort has gone into imporving the luminous efficacy of such lamps by improving the phosphor blend, the fill gas pressure, and tube geometry. Such effort has, fundamentally, been directed toward optimizing the number density of mercury atoms in the aggregate and optimizing the photon conversion efficiencies of the fluorescent materials.

Defining a quantum of resonance ratiation energy as the energy of a single mercury atom excited to its $^3P_1$ state, in its escape from the discharge tube such a quantum may exist either as an excited atom or as a photon emitted by an excited atom. Because of the presence of mercury atoms in their lowest energy state (ground state) in the plasma which can absorb such photons, thereby becoming excited atoms, which may subsequently re-emit a photon of substantially the same energy as they absorbed, a quantum of resonance radiation energy (created by electron impact excitation of a mercury atom) escapes the discharge tube by a series of stepwise emissions and absorptions, alternately changing its form from excited atom to photon and vice versa before it finally escapes the discharge tube as a photon.

Each time the quantum is absorbed and becomes an excited atom, a period equal to the natural life time of the excited atom (about $1.17\times10^{-7}$ second) must elapse on the average before it can be re-emitted. Thus, the multiple emission, absorption and re-emission process, known as imprisonment of radiance radiation, greatly prolongs the length of time the quantum spends as an excited atom before it can escape the tube to many times the single natural lifetime it would reside as an excited atom if the photon escaped without re-absorption.

While the quantum resides as an excited atom, there is a finite probability that some non-radiative process may occur to dissipate its energy. The longer the imprisonment time, that is, the time required for the quantum to escape, the greater is the total probability of such non-radiative loss and the lower the efficiency. The problem of imprisonment time and quantum escape has been considered theoretically; see, for example, "Imprisonment of Resonance Radiation in Gases. II" by T. Holstein (Physical Review, Volume 83, Number 6, Sept. 15, 1951) and "Electric Discharge Lamps" by John F. Waymouth, the M.I.T. Press (1971), Cambridge, Massachusetts, and London, England, pages 122–126. Lamp optimization relating, for example, to envelope diameter, fill pressure or operating temperature, has been based on prior art treatments of the problem of radiation transfer. A common feature of all of these treatments known to the prior art is that imprisonment time increases on the average as the concentration of total mercury atoms in the vapor phase increases, and this fact is responsible for the declining efficiency of such lamps for mercury pressures higher than $6\times10^{-3}$ torr, corresponding to the pressure of saturated vapor above liquid mercury at 40° C., which is about the pressure in fluorescent lamps.

As previously stated, the fluorescent lamp operates by using resonance radiation from a plasma to excite a phosphor which emits visible light. Previous improvements in the performance of the discharge have been attained by changing lamp structure, fill gas composition and pressure, and mercury pressure. We have discovered that the efficiency of fluorescent lamps, and of any mercury-containing arc discharge device for converting electrical energy into resonance radiation, can be improved by altering the content of the mercury in the device. This invention is based on the recognition that the imprisonment time of mercury resonance radiation depends not only on the number density of mercury atoms in the aggregate, but also on the number density of the various mercury isotopes. If, for example, the 254 nm emissions of the individual isotopes have the same spectral shape but lie in distinct, non-overlapping, wavelength regions, and if each of the isotopes has the same probability of being excited and subsequently emitting 254 nm radiation, then each isotope could only absorb radiation emitted by an isotope of identical mass number, and one would expect minimum imprisonment and maximum 254 nm radiation if all isotopes were equally abundant. Such an isotopic distribution stands in marked contrast to that in naturally-occurring mercury, which is as follows:

| Isotope (Mass Number) | Natural Abundance |
|---|---|
| 196 | 0.146% |
| 198 | 10.0% |
| 199 | 16.8% |
| 200 | 23.1% |
| 201 | 13.2% |
| 202 | 29.8% |
| 204 | 6.85% |

In fact, the 254 nm spectral emissions of some of the isotopes do overlap, but the emission of the $Hg^{196}$ isotope is not one of them. We have discovered that the entrapment time of 254 nm mercury resonance radiation can be reduced and the output of 254 nm resonance radiation can be increased in a device which incorporates relatively more of the $Hg^{196}$ isotope than is found in naturally-occurring mercury.

The drawing shows a mercury-containing arc discharge device fabricated so as to permit measurement of the 254 nm resonance radiation. The device comprises a sealed 4 foot envelope 1 having electrodes 2 at each end thereof. Envelope 1 contains mercury and an inert gas such as argon. An intermediate short length 3 of envelope 1 is made of fused silica instead of the usual soft glass which comprises the rest of envelope 1 in order to transmit 254 nm radiation, soft glass being opaque to such radiation.

Three such devices were made about 5 mg of mercury were added to each device. In the first device, used as a control, the mercury was naturally-occurring mercury, having the isotopic distribution previously mentioned. In the second and third devices the amount of $Hg^{196}$ isotope in the 5 mg of mercury was increased as follows. Enriched $Hg^{196}$ was obtained from Oak Ridge National Labs, Oak Ridge, Tennessee, in the form of mercuric oxide the mercury content of which was 33.97% $Hg^{196}$. The isotopic distribution of said mercury content was as follows: $Hg^{196}$—33.97%; $Hg^{198}$—17.59%; $Hg^{199}$—16.02%; $Hg^{200}$—14.72%; $Hg^{201}$— 5.93%; $Hg^{202}$—10.19%; $Hg^{204}$—1.58%. The mercuric oxide was thermally decomposed to yield elemental mercury, 2.25 mg of which was added to the second device and 0.55 mg of which was added to the third device. In each device, sufficient naturally-occurring mercury was added to bring the total mercury charge to about 5 mg. The individual mercury compositions were as follows:

| Isotope | Control | #2 | #3 |
|---|---|---|---|
| 196 | 0.146% | 15.3% | 3.75% |
| 198 | 10.0 | 13.4 | 10.8 |
| 199 | 16.8 | 16.5 | 16.75 |
| 200 | 23.1 | 19.35 | 22.2 |
| 201 | 13.2 | 9.95 | 12.4 |
| 202 | 29.8 | 21.0 | 27.7 |
| 204 | 6.85 | 4.5 | 6.3 |

The devices were operated at 430 milliampere constant current and the relative outputs of 254 nm radiation were measured using a monochromator and photomultiplier tube by techniques well known in the art. The outputs of devices 2 and 3 were 4.2% and 4.8% greater, respectively, than that of the control. This is a significant gain. In a 4 foot fluorescent lamp, it represents an improvement of better than 100 lumens. At a constant wattage of 40 watts, device #3 yielded a 3.6% increase in output over the control.

It is apparent that substantial enhancement of the efficiency of generation of the 254 nm resonance radiation emission has been achieved, and surprisingly, that such increase in efficiency has occurred for $Hg^{196}$ isotope enrichments which are well below the equal proportion value. Since the commercial practicality of this invention will ultimately depend on the cost of enriching natural mercury in the $Hg^{196}$ isotope, and that cost will strongly depend on the level of enrichment required, it is clear that this is a highly significant finding. On the basis of the results of devices 2 and 3, it is expected that an enrichment of $Hg^{196}$ isotope as little as 1% would yield a significantly economic increase in efficiency.

The only prior art teachings of which we are aware regarding isotope effects on the imprisonment time of 254 nm resonance radiation in mercury vapor are those in "Isotope Effect in the Imprisonment of Resonance Radiation" by T. Holstein, D. Alpert, & A. O. McCoubrey (Physical Review, Volume 85, Number 4 Mar. 15, 1952). The authors investigated the imprisonment time of a mercury vapor mixture consisting predominantly of the single isotope $Hg^{198}$, with small impurities of $Hg^{199}$ and $Hg^{200}$. They determined that about a six fold longer imprisonment time occurred at vapor pressures in the vicinity of $6\times10^{-3}$ torr than in natural mercury. In no case did they observe an imprisonment time shorter than that of natural mercury.

Although the improvement in efficiency of conversion of electrical energy to mercury resonance radiation has been demonstrated primarily for 254 nm radiation, it is equally applicable to mercury resonance radiation at other frequencies, for example, 185 nm. The 254 nm radiation is of primary importance in fluorescent lamps while 185 nm radiation is of importance in ozone producing devices as well as in some types of fluorescent lamps.

We claim:

1. A mercury-containing arc discharge device for converting electrical energy into resonance radiation, the $Hg^{196}$ content of the mercury within the device being greater than that in natural mercury in order to increase the efficiency of converting said electrical energy into said resonance radiation.

2. The device in claim 1 wherein said $Hg^{196}$ content is greater than 0.146%.

3. A mercury-containing arc discharge device for converting electrical energy into resonance radiation, the isotopic distribution of the mercury being altered from that of natural mercury so as to reduce imprisonment time of resonance radiation, thereby increasing the efficiency of converting electrical energy into resonance radiation.

4. In a fluorescent lamp of the type comprising an envelope having an electrode at each end, a phosphor coating on the envelope, and containing a fill including mercury and an inert gas, the improvement comprising the isotopic distribution of the mercury being altered from that of naturally-occurring mercury so as to improve lamp efficiency.

5. The lamp of claim 4 wherein said isotopic distribution of mercury contains a higher proportion of $Hg^{196}$ isotope than is present in naturally-occurring mercury.

6. The lamp of claim 5 wherein the $Hg^{196}$ content of said mercury is greater than 0.146%.

7. The lamp of claim 5 wherein the $Hg^{196}$ content of said mercury is at least about 1%.

* * * * *